US011385036B2

(12) United States Patent
Preiss et al.

(10) Patent No.: US 11,385,036 B2
(45) Date of Patent: *Jul. 12, 2022

(54) CONDUCTIVE DETONATING CORD FOR PERFORATING GUN

(71) Applicant: DynaEnergetics Europe GmbH, Troisdorf (DE)

(72) Inventors: Frank Haron Preiss, Bonn (DE); Liam McNelis, Bonn (DE); Thilo Scharf, Letterkenny (IE); Christian Eitschberger, Munich (DE); Bernhard Scharfenort, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 21 days.

This patent is subject to a terminal disclaimer.

(21) Appl. No.: 17/076,099

(22) Filed: Oct. 21, 2020

(65) Prior Publication Data

US 2021/0048283 A1 Feb. 18, 2021

Related U.S. Application Data

(60) Continuation of application No. 16/503,839, filed on Jul. 5, 2019, now Pat. No. 10,845,177, which is a (Continued)

(51) Int. Cl.
*F42C 19/12* (2006.01)
*F42D 1/04* (2006.01)
(Continued)

(52) U.S. Cl.
CPC ..... *F42C 19/12* (2013.01); *E21B 43/119* (2013.01); *E21B 43/1185* (2013.01); *F42B 1/02* (2013.01); *F42D 1/043* (2013.01); *F42D 1/055* (2013.01)

(58) Field of Classification Search
CPC ..... F42D 1/055; F42D 1/043; F42C 19/12; E21B 43/1185
(Continued)

(56) References Cited

U.S. PATENT DOCUMENTS 2,216,359 A 10/1940 Spencer
2,228,873 A 1/1941 Hardt et al.
(Continued)

FOREIGN PATENT DOCUMENTS

CA 2821506 A1 1/2015
CA 2824838 A1 2/2015
(Continued)

OTHER PUBLICATIONS

Dynaenergetics Europe; Complaint and Demand for Jury Trial, Civil Action No. 1 20-cv-03665; dated Dec. 15, 2020; 8 pages.
(Continued)

*Primary Examiner* — John Cooper
(74) *Attorney, Agent, or Firm* — Moyles IP, LLC

(57) ABSTRACT

A detonating cord for using in a perforating gun includes an explosive layer and an electrically conductive layer extending around the explosive layer. The electrically conductive layer is configured to relay a communication signal along a length of the detonating cord. In an embodiment, a protective jacket extends around the electrically conductive layer of the detonating cord. The detonating cord may be assembled in a perforating gun to relay a communication signal from a top connector to a bottom connector of the perforating gun, and to propagate a detonating explosive stimulus along its length to initiate shaped charges of the perforating gun. A plurality of perforating guns, including the detonating cord, may be connected in series, with the detonating cord of a first perforating gun in communication with the detonating cord of a second perforating gun.

20 Claims, 8 Drawing Sheets

Related U.S. Application Data division of application No. 16/152,933, filed on Oct. 5, 2018, now Pat. No. 10,386,168.

(60) Provisional application No. 62/683,083, filed on Jun. 11, 2018.

(51) Int. Cl.

| | |
|---|---|
| ***F42B 1/02*** | (2006.01) |
| ***E21B 43/1185*** | (2006.01) |
| ***E21B 43/119*** | (2006.01) |
| ***F42D 1/055*** | (2006.01) |

(58) Field of Classification Search

USPC ..... 102/275.12, 275.8, 275.7, 275.6, 275.5, 102/275.4, 275.2, 275.1

See application file for complete search history.

(56) References Cited

U.S. PATENT DOCUMENTS 2,358,466 A 9/1944 Miller
2,418,486 A 4/1947 Smylie
2,439,394 A 4/1948 Lanzalotti et al.
2,598,651 A 5/1952 Spencer
2,889,775 A 6/1959 Owen
2,906,339 A 9/1959 Griffin
2,982,210 A 5/1961 Andrew et al.
3,013,491 A 12/1961 Poulter
3,125,024 A 3/1964 Hicks
3,158,680 A 11/1964 Lovitt et al.
3,170,400 A 2/1965 Nelson
3,246,707 A 4/1966 Bell
3,357,355 A 12/1967 Roush
3,374,735 A 3/1968 Moore
3,504,723 A 4/1970 Cushman et al.
3,565,188 A 2/1971 Hakala
3,731,626 A * 5/1973 Grayson ..... C06C 5/04 102/275.8
3,859,921 A 1/1975 Stephenson
3,892,455 A 7/1975 Sotolongo
4,007,790 A 2/1977 Henning
4,007,796 A 2/1977 Boop
4,024,817 A * 5/1977 Calder, Jr. ..... C06C 5/04 102/275.7
4,058,061 A 11/1977 Mansur, Jr. et al.
4,080,902 A * 3/1978 Goddard ..... C06C 5/04 102/200
4,100,978 A 7/1978 Boop
4,107,453 A 8/1978 Erixon
4,132,171 A 1/1979 Pawlak et al.
4,140,188 A 2/1979 Vann
4,182,216 A 1/1980 DeCaro
4,191,265 A 3/1980 Bosse-Platiere
4,220,087 A 9/1980 Posson
4,266,613 A 5/1981 Boop
4,290,486 A 9/1981 Regalbuto
4,312,273 A 1/1982 Camp
4,346,954 A 8/1982 Appling
4,411,491 A 10/1983 Larkin et al.
4,455,941 A 6/1984 Walker et al.
4,491,185 A 1/1985 McClure
4,496,008 A 1/1985 Pottier et al.
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,640,370 A 2/1987 Wetzel
4,650,009 A 3/1987 McClure et al.
4,657,089 A 4/1987 Stout
4,660,910 A 4/1987 Sharp et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,776,393 A 10/1988 Forehand et al.
4,790,383 A 12/1988 Savage et al.
4,800,815 A 1/1989 Appledorn et al.
4,850,438 A 7/1989 Regalbuto
4,889,183 A 12/1989 Sommers et al.
4,998,478 A 3/1991 Beck
5,001,981 A 3/1991 Shaw
5,010,821 A 4/1991 Blain
5,027,708 A 7/1991 Gonzalez et al.
5,052,489 A 10/1991 Carisella et al.
5,060,573 A 10/1991 Montgomery et al.
5,083,929 A 1/1992 Dalton
5,088,413 A 2/1992 Huber
5,105,742 A 4/1992 Sumner
5,159,145 A 10/1992 Carisella et al.
5,159,146 A 10/1992 Carisella et al.
5,223,664 A 6/1993 Rogers
5,322,019 A 6/1994 Hyland
5,347,929 A 9/1994 Lerche et al.
5,392,851 A 2/1995 Arend
5,392,860 A 2/1995 Ross
5,436,791 A 7/1995 Furano et al.
5,529,509 A 6/1996 Hayes et al.
5,540,154 A * 7/1996 Wilcox ..... C06C 5/00 102/275.1
5,558,531 A 9/1996 Ikeda et al.
5,603,384 A 2/1997 Bethel et al.
5,648,635 A 7/1997 Lussier et al.
5,703,319 A 12/1997 Fritz et al.
5,759,056 A 6/1998 Costello et al.
5,765,962 A 6/1998 Cornell et al.
5,769,661 A 6/1998 Nealis
5,775,426 A 7/1998 Snider et al.
5,785,130 A 7/1998 Wesson et al.
5,816,343 A 10/1998 Markel et al.
5,837,924 A * 11/1998 Austin ..... C06C 5/04 264/3.4
5,837,925 A 11/1998 Nice
5,992,289 A 11/1999 George et al.
6,006,833 A 12/1999 Burleson et al.
6,012,525 A 1/2000 Burleson et al.
6,085,659 A 7/2000 Beukes et al.
6,112,666 A 9/2000 Murray et al.
6,297,447 B1 10/2001 Bumett et al.
6,298,915 B1 10/2001 George
6,305,287 B1 10/2001 Capers et al.
6,354,374 B1 3/2002 Edwards et al.
6,386,108 B1 5/2002 Brooks et al.
6,408,758 B1 6/2002 Duguet
6,412,415 B1 7/2002 Kothari et al.
6,418,853 B1 7/2002 Duguet et al.
6,439,121 B1 8/2002 Gillingham
6,467,415 B2 10/2002 Menzel et al.
6,487,973 B1 12/2002 Gilbert, Jr. et al.
6,497,285 B2 12/2002 Walker
6,508,176 B1 1/2003 Badger et al.
6,651,747 B2 11/2003 Chen et al.
6,739,265 B1 5/2004 Badger et al.
6,742,602 B2 6/2004 Trotechaud
6,752,083 B1 6/2004 Lerche et al.
6,772,868 B2 8/2004 Warner
6,843,317 B2 1/2005 Mackenzie
6,851,471 B2 2/2005 Barlow et al.
6,976,857 B1 12/2005 Shukla et al.
7,107,908 B2 9/2006 Forman et al.
7,182,611 B2 2/2007 Borden et al.
7,193,527 B2 3/2007 Hall
7,237,626 B2 7/2007 Gurjar et al.
7,278,491 B2 10/2007 Scott
7,306,038 B2 12/2007 Challacombe
7,347,278 B2 3/2008 Lerche et al.
7,347,279 B2 3/2008 Li et al.
7,350,448 B2 4/2008 Bell et al.
7,357,083 B2 4/2008 Takahara et al.
7,404,725 B2 7/2008 Hall et al.
7,441,601 B2 10/2008 George et al.
7,481,662 B1 1/2009 Rehrig

(56) References Cited

U.S. PATENT DOCUMENTS 7,553,078 B2 6/2009 Hanzawa et al.
7,565,927 B2 7/2009 Gerez et al.
7,568,429 B2 8/2009 Hummel et al.
7,640,857 B2 1/2010 Kneisl
7,661,366 B2 2/2010 Fuller et al.
7,661,474 B2 2/2010 Campbell et al.
7,726,396 B2 6/2010 Briquet et al.
7,735,578 B2 6/2010 Loehr et al.
7,748,447 B2 7/2010 Moore
7,752,971 B2 7/2010 Loehr
7,762,172 B2 7/2010 Li et al.
7,762,331 B2 7/2010 Goodman et al.
7,762,351 B2 7/2010 Vidal
7,778,006 B2 8/2010 Stewart et al.
7,810,430 B2 10/2010 Chan et al.
7,823,508 B2 11/2010 Anderson et al.
7,908,970 B1 3/2011 Jakaboski et al.
7,929,270 B2 4/2011 Hummel et al.
7,952,035 B2 5/2011 Falk et al.
7,980,874 B2 7/2011 Finke et al.
8,066,083 B2 11/2011 Hales et al.
8,069,789 B2 12/2011 Hummel et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.
8,256,337 B2 9/2012 Hill
8,297,345 B2 10/2012 Emerson
8,327,746 B2 12/2012 Behrmann et al.
8,388,374 B2 3/2013 Grek et al.
8,395,878 B2 3/2013 Stewart et al.
8,449,308 B2 5/2013 Smith
8,451,137 B2 5/2013 Bonavides et al.
8,661,978 B2 3/2014 Backhus et al.
8,689,868 B2 4/2014 Lerche et al.
8,695,506 B2 4/2014 Lanclos
8,863,665 B2 10/2014 DeVries et al.
8,869,887 B2 10/2014 Deere et al.
8,875,787 B2 11/2014 Tassaroli
8,881,816 B2 11/2014 Glenn et al.
8,881,836 B2 11/2014 Ingram
8,884,778 B2 11/2014 Lerche et al.
8,904,935 B1 12/2014 Brown et al.
8,943,943 B2 2/2015 Tassaroli
8,960,093 B2 2/2015 Preiss et al.
8,985,023 B2 3/2015 Mason
8,997,852 B1 4/2015 Lee et al.
9,080,433 B2 7/2015 Lanclos et al.
9,133,695 B2 9/2015 Xu
9,145,764 B2 9/2015 Burton et al.
9,175,553 B2 11/2015 Mccann et al.
9,181,790 B2 11/2015 Mace et al.
9,194,219 B1 11/2015 Hardesty et al.
9,270,051 B1 2/2016 Christiansen et al.
9,284,819 B2 3/2016 Tolman et al.
9,382,783 B2 7/2016 Langford et al.
9,441,465 B2 9/2016 Tassaroli
9,466,916 B2 10/2016 Li et al.
9,476,289 B2 10/2016 Wells
9,494,021 B2 11/2016 Parks et al.
9,523,271 B2 12/2016 Bonavides et al.
9,574,416 B2 2/2017 Wright et al.
9,581,422 B2 2/2017 Preiss et al.
9,598,942 B2 3/2017 Wells et al.
9,605,937 B2 3/2017 Eitschberger et al.
9,677,363 B2 6/2017 Schacherer et al.
9,689,223 B2 6/2017 Schacherer et al.
9,702,680 B2 7/2017 Parks et al.
9,784,549 B2 10/2017 Eitschberger
9,822,618 B2 11/2017 Eitschberger
9,903,192 B2 2/2018 Entchev et al.
9,926,750 B2 3/2018 Ringgenberg
9,926,755 B2 3/2018 Van Petegem et al.
10,000,994 B1 6/2018 Sites
10,066,921 B2 9/2018 Eitschberger
10,077,641 B2 9/2018 Rogman et al.
10,138,713 B2 11/2018 Tolman et al.
10,151,152 B2 12/2018 Wight et al.
10,151,180 B2 12/2018 Robey et al.
10,188,990 B2 1/2019 Burmeister et al.
10,190,398 B2 1/2019 Goodman et al.
10,273,788 B2 4/2019 Bradley et al.
10,309,199 B2 6/2019 Eitschberger
10,337,270 B2 7/2019 Carisella et al.
10,352,136 B2 7/2019 Goyeneche
10,352,144 B2 7/2019 Entchev et al.
10,386,168 B1 * 8/2019 Preiss ..... E21B 43/1185
10,429,161 B2 10/2019 Parks et al.
10,472,938 B2 11/2019 Parks et al.
10,669,822 B2 6/2020 Eitschberger
2002/0020320 A1 2/2002 Lebaudy et al.
2002/0062991 A1 5/2002 Farrant et al.
2003/0000411 A1 1/2003 Cernocky et al.
2003/0001753 A1 1/2003 Cernocky et al.
2004/0141279 A1 7/2004 Amano et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myers et al.
2005/0257710 A1 11/2005 Monetti et al.
2006/0013282 A1 1/2006 Hanzawa et al.
2007/0084336 A1 4/2007 Neves
2007/0125540 A1 6/2007 Gerez et al.
2007/0158071 A1 7/2007 Mooney et al.
2008/0047456 A1 2/2008 Li et al.
2008/0047716 A1 2/2008 McKee et al.
2008/0073081 A1 3/2008 Frazier et al.
2008/0110612 A1 5/2008 Prinz et al.
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2009/0050322 A1 2/2009 Hill et al.
2009/0159283 A1 * 6/2009 Fuller ..... C06C 5/04
166/297
2009/0272519 A1 11/2009 Green et al.
2009/0272529 A1 11/2009 Crawford
2009/0301723 A1 12/2009 Gray
2010/0000789 A1 1/2010 Barton et al.
2010/0089643 A1 4/2010 Vidal
2010/0096131 A1 4/2010 Hill et al.
2010/0163224 A1 7/2010 Strickland
2010/0230104 A1 9/2010 Nölke et al.
2011/0024116 A1 2/2011 McCann et al.
2011/0042069 A1 2/2011 Bailey et al.
2012/0085538 A1 4/2012 Guerrero et al.
2012/0094553 A1 4/2012 Fujiwara et al.
2012/0160491 A1 6/2012 Goodman et al.
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0062055 A1 3/2013 Tolman et al.
2013/0118342 A1 5/2013 Tassaroli
2013/0199843 A1 8/2013 Ross
2013/0248174 A1 9/2013 Dale et al.
2014/0033939 A1 2/2014 Priess et al.
2014/0131035 A1 5/2014 Entchev et al.
2015/0176386 A1 6/2015 Castillo et al.
2015/0226044 A1 8/2015 Ursi et al.
2015/0330192 A1 11/2015 Man et al.
2015/0376991 A1 12/2015 Mcnelis et al.
2016/0040520 A1 2/2016 Tolman et al.

(56) References Cited

U.S. PATENT DOCUMENTS

| | | | |
|---|---|---|---|
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0273902 | A1 | 9/2016 | Eitschberger |
| 2016/0356132 | A1 | 12/2016 | Burmeister et al. |
| 2017/0030693 | A1 | 2/2017 | Preiss et al. |
| 2017/0052011 | A1 | 2/2017 | Parks et al. |
| 2017/0058649 | A1 | 3/2017 | Geerts et al. |
| 2017/0074078 | A1 | 3/2017 | Eitschberger |
| 2017/0145798 | A1 | 5/2017 | Robey et al. |
| 2017/0167233 | A1 | 6/2017 | Sampson et al. |
| 2017/0199015 | A1 | 7/2017 | Collins et al. |
| 2017/0211363 | A1* | 7/2017 | Bradley ..... E21B 43/1185 |
| 2017/0241244 | A1 | 8/2017 | Barker et al. |
| 2017/0268860 | A1 | 9/2017 | Eitschberger |
| 2017/0276465 | A1 | 9/2017 | Parks et al. |
| 2017/0314372 | A1 | 11/2017 | Tolman et al. |
| 2017/0314373 | A9 | 11/2017 | Bradley et al. |
| 2018/0030334 | A1 | 2/2018 | Collier et al. |
| 2018/0038208 | A1 | 2/2018 | Eitschberger et al. |
| 2018/0135398 | A1 | 5/2018 | Entchev et al. |
| 2018/0202789 | A1 | 7/2018 | Parks et al. |
| 2018/0202790 | A1 | 7/2018 | Parks et al. |
| 2018/0209250 | A1 | 7/2018 | Daly et al. |
| 2018/0209251 | A1 | 7/2018 | Robey et al. |
| 2018/0274342 | A1 | 9/2018 | Sites |
| 2018/0299239 | A1 | 10/2018 | Eitschberger et al. |
| 2018/0306010 | A1 | 10/2018 | Von Kaenel et al. |
| 2018/0318770 | A1 | 11/2018 | Eitschberger et al. |
| 2019/0040722 | A1 | 2/2019 | Fang et al. |
| 2019/0048693 | A1 | 2/2019 | Henke et al. |
| 2019/0049225 | A1 | 2/2019 | Eitschberger |
| 2019/0085685 | A1 | 3/2019 | McBride |
| 2019/0162055 | A1 | 5/2019 | Collins et al. |
| 2019/0162056 | A1 | 5/2019 | Sansing |
| 2019/0195054 | A1 | 6/2019 | Bradley et al. |
| 2019/0211655 | A1 | 7/2019 | Bradley et al. |
| 2019/0219375 | A1 | 7/2019 | Parks et al. |
| 2019/0234188 | A1 | 8/2019 | Goyeneche |
| 2019/0242222 | A1 | 8/2019 | Eitschberger |
| 2019/0257181 | A1 | 8/2019 | Langford et al. |
| 2019/0284889 | A1 | 9/2019 | LaGrange et al. |
| 2019/0292887 | A1 | 9/2019 | Austin, II et al. |
| 2019/0309606 | A1 | 10/2019 | Loehken et al. |
| 2019/0316449 | A1 | 10/2019 | Schultz et al. |
| 2019/0330961 | A1 | 10/2019 | Knight et al. |
| 2019/0338612 | A1 | 11/2019 | Holodnak et al. |
| 2019/0353013 | A1 | 11/2019 | Sokolove et al. |
| 2020/0024934 | A1 | 1/2020 | Eitschberger et al. |
| 2020/0024935 | A1 | 1/2020 | Eitschberger et al. |
| 2020/0032626 | A1 | 1/2020 | Parks et al. |
| 2020/0063537 | A1 | 2/2020 | Langford et al. |
| 2020/0399995 | A1 | 12/2020 | Preiss et al. |

FOREIGN PATENT DOCUMENTS

| | | | | |
|---|---|---|---|---|
| CA | 2941648 | A1 | 9/2015 | |
| CA | 3021913 | A1 | 2/2018 | |
| CN | 35107897 | A | 9/1986 | |
| CN | 201209435 | | 3/2009 | |
| CN | 101397890 | A | 4/2009 | |
| CN | 101435829 | A | 5/2009 | |
| CN | 101454635 | A | 6/2009 | |
| CN | 201620848 | U | 11/2010 | |
| CN | 103485750 | A | 1/2014 | |
| CN | 208870580 | U | 5/2019 | |
| CN | 209195374 | U | 8/2019 | |
| CN | 110424930 | A | 11/2019 | |
| CN | 209908471 | U | 1/2020 | |
| DE | 102007007498 | | 10/2015 | |
| EP | 0385614 | A2 | 9/1990 | |
| EP | 0385614 | A2 * | 9/1990 | ..... C06C 5/06 |
| EP | 0180520 | B1 | 5/1991 | |
| EP | 0482969 | B1 | 8/1996 | |
| GB | 0385614 | A2 * | 1/1989 | |
| GB | 2531450 | B | 2/2017 | |
| GB | 2548101 | A | 9/2017 | |
| RU | 2091567 | C1 | 9/1997 | |
| RU | 2295694 | C2 | 3/2007 | |
| RU | 93521 | U1 | 4/2010 | |
| RU | 100552 | U1 | 12/2010 | |
| RU | 2434122 | C2 | 11/2011 | |
| RU | 2633904 | C1 | 10/2017 | |
| WO | 2000020821 | A1 | 4/2000 | |
| WO | 9159401 | A1 | 8/2001 | |
| WO | 2001059401 | A1 | 8/2001 | |
| WO | 2009091422 | A2 | 7/2009 | |
| WO | 2012006357 | A2 | 1/2012 | |
| WO | 2012006357 | A3 | 4/2012 | |
| WO | 2014007843 | A1 | 1/2014 | |
| WO | 2014193397 | A1 | 12/2014 | |
| WO | 2015006869 | A1 | 1/2015 | |
| WO | 2015028204 | A2 | 3/2015 | |
| WO | 2015196095 | A1 | 12/2015 | |
| WO | 2018009223 | A1 | 1/2018 | |
| WO | 2019117861 | A1 | 6/2019 | |
| WO | 2019148009 | A2 | 8/2019 | |
| WO | 2019204137 | A1 | 10/2019 | |
| WO | 2020002383 | A1 | 1/2020 | |

OTHER PUBLICATIONS

International Bureau; International Preliminary Reporton Patentability for PCT Application #PCT/EP2019/063214; dated Dec. 24, 2020; 9 pages.

Argentine Patent Office; Boletin De Patentes No. 1130 for AR Application No. 20190101563; dated Jan. 21, 2021; 1 page.

Baumann et al.; Perforating Innovations—Shooting Holes in Performance Models; Oilfield Review, Autumn 2014, vol. 26, Issue No. 3 pp. 14-31; 18 pages.

C&J Energy Services; Gamechanger Perforating System Description; 2018; 1 pages.

C&J Energy Services; Gamechanger Perforating System Press Release; 2018; 4 pages.

CT Corporation System; Proof of Service of the Complaint; dated May 1, 2020; 39 pages.

Dynaenergetics Europe GmbH; Principal and Response Brief of Cross-Appellant for United States Court of Appeals case No. 2020-2163, -2191; dated Jan. 11, 2021; 95 pages.

Dynaenergetics Europe; Complaint and Demand for Jury Trial, Civil Action No. 6:20-cv-01201; dated Dec. 30, 2020; 12 pages.

Dynaenergetics Europe; Plaintiffs' Pending Motion for Reconsideration for Civil Action No. 4:17-cv-03784 dated Jan. 21, 2021; 4 pages.

G&H Diversified Manufacturing, LP; Complaint for Declaratory Judgement for Civil Action No. 3:20-cv-00376; dated Dec. 14, 2020; 7 pages.

McBride Michael; Declaration for IPR2021-00082; dated Oct. 20, 2020; 3 pages.

Nextier Oilfield Solutions Inc; Petition for Inter Partes Review No. IPR2021-00082; dated Oct. 21, 2020; 111 pages.

Nexus Perforating LLC; Complaint and Demand for Jury Trial for Civil Case No. 4:20-cv-01539; dated Apr. 30, 2020; 11 pages.

Nexus Perforating; Double Nexus Connect (Thunder Gun System) Description; Retrieved from the internet Jan. 27, 2021; 6 pages.

Parrott, Robert; Declaration for IPR2021-00082; dated Oct. 20, 2020; 110 pages.

Smithson, Anthony; Declaration Declaration for IPR2021-00082; dated Oct. 16, 2020; 2 pages.

United States District Court Southern District of Texas Houston and Galveston Divisions; Seventh Supplemental Order; Sep. 17, 2020; 3 pages.

United States Patent and Trademark Office; Non-Final Office Action for U.S. Appl. No. 17/007,574 dated Jan. 29, 2021; 11 pages.

United States Patent and Trademark Office; Notice of Allowance for U.S. Appl. No. 16/809,729 dated Jan. 26, 2021; 9 pages.

(56) References Cited

OTHER PUBLICATIONS

United States Patent Trial and Appeal Board; Decision Denying Institution of Post-Grant Review; PGR No. 2020-00072; dated Jan. 19, 2021; 38 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Industrial Property Office, Czech Republic; Office Action; CZ App. No. PV 2017-675; dated Dec. 17, 2018; 2 pages.
Instituto Nacional De La Propiedad Industrial; Office Action for AR Appl. No. 20140102653; dated May 9, 2019 (1 page).
Intellectual Property India, Office Action of IN Application No. 201647004496, dated Jun. 7, 2019, 6 pgs.
International Searching Authority, International Preliminary Report on Patentability for PCT App. No.PCT/EP2014/065752; dated Mar. 1, 2016, 10 pgs.
International Searching Authority, International Search Report and Written Opinion for PCT App. No. PCT/IB2019/000569; dated Oct. 9, 2019, 12 pages.
International Searching Authority, International Search Report and Written Opinion of International App. No. PCT/EP2019/063214, which is in the same family as U.S. Appl. No. 16/503,839, dated Jul. 29, 2019, 13 pages.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/069165; dated Oct. 22, 2019; 13 pages.
International Searching Authority; International Search Report and Written Opinion for PCT App. No. PCT/US2015/018906; dated Jul. 10, 2015; 12 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.
McNnelis et al.; High-Performance Plug-and-Perf Completions in Unconventional Wells; Society of Petroleum Engineers Annual Technical Conference and Exhibition; Sep. 28, 2015.
merriam-webster.com, Insulator Definition, https://www.merriam-webster.com/dictionary/insulator, Jan. 31, 2018, 4 pages.
Norwegian Industrial Property Office; Office Action and Search Report for NO App. 20160017; dated Jun. 15, 2017; 5 pages.
Norwegian Industrial Property Office; Office Action and Search Report for NO App. 20171759; dated Jan. 14, 2020; 6 pages.
Norwegian Industrial Property Office; Office Action for NO Appl. No. 20160017; dated Dec. 4, 2017; 2 pages.
Norwegian Industrial Property Office; Opinion for NO Appl. No. 20171759; dated Apr. 5, 2019; 1 page.
OSO Perforating; "OsoLite"; promotional brochure; Jan. 2019.
Owen Oil Tools & Pacific Scientific; RF-Safe Green Det, Side Block for Side Initiation, Jul. 26, 2017, 2 pgs.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.
PCT Search Report and Written Opinion, dated May 4, 2015: See Search Report and Written opinion for PCT Application No. PCT/EP2014/065752, 12 pgs.
Robert Parrott, Case IPR2018-00600 for U.S. Pat. No. 9,581,422 B2, Declaration regarding Patent Invalidity, dated Jun. 29, 2020, 146 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger, Perforating Services Catalog, 2008, 521 pages.
SIPO, Search Report dated Mar. 29, 2017, in Chinese: See Search Report for CN App. No. 201480040456.9, 12 pgs. English Translation 3 pgs.).
Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. Mo. 201811156092.7; dated Jun. 16, 2020; 6 pages (Eng Translation 8 pages).
State Intellectual Property Office, P.R. China; First Office Action for Chinese App No. 201580011132.7 dated Jun. 27, 2018; 5 pages (Eng. Translation 9 pages).
State Intellectual Property Office, P.R. China; First Office Action for Chinese App. No. 201610153426. X; dated Mar. 20, 2019; 6 pages (Eng Translation 11 pages).
State Intellectual Property Office, P.R. China; First Office Action for CN App. No. 201480047092.7 dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; date Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9 dated Nov. 29, 2017; 5 pages (English translation 1 page).
State Intellectual Property Office, P.R. China; Second Office Action for CN App. No. 201480047092.7 dated Jan. 4, 2018; 3 pages.
SWM International Inc.; "Thunder Disposable Gun System"; promotional brochure; Oct. 2018; 5 pgs.
Thilo Scharf; "DynaEnergetics exhibition and product briefing"; pp. 5-6; presented at 2014 Offshore Technology Conference; May 2014.
Thilo Scharf; "DynaStage & BTM Introduction"; pp. 4-5, 9; presented at 2014 Offshore Technology Conference; May 2014.
U.S. Patent Trial and Appeal Board, Institution of Inter Partes Review of U.S. Pat. No. 9,581,422, Case PR2018-00600, Aug. 21, 2018, 9 pages.
United States District Court for the Southern District of Texas Houston Division, Case 4:19-cv-0161 1 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-0161 1 for U.S. Pat. No. 9,581,422B2, Plaintiffs' Motion to Dismiss and Exhibits, dated Jun. 17, 2019, 63 ogs.
United States District Court for the Southern District of Texas Houston Division, Case 4:19-cv-0161 1 for U.S. Pat. No. 9,581,42282, Plaintiffs Complaint and Exhibits, dated May 2, 2019, 26 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020,27 pgs.
USPTO; Notice of Allowance for U.S. Appl. No. 14/904,788; dated Jul. 6, 2016; 8 pages.

(56) References Cited

OTHER PUBLICATIONS

USPTO; Supplemental Notice of Allowability for U.S. Appl. No. 14/904,788; dated Jul. 21, 2016; 2 pages.
Vigor USA; "Sniper Addressable System"; promotional brochure; Sep. 2019.
VIGOR, Perforating Gun Accessories,China Vigor Drilling Oil Tools and Equipment Co.,Ltd., Sep. 14, 2018,4 pgs., http://www.vigordrilling.com/completion-tools/perforating-gun-accessories.html.
Nade et al., Field Tests Indicate New Perforating Devices Improve Efficiency in Casing Completion Operations, SPE 381, pp. 1069-1073, Oct. 1962, 5 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018,47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019,19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Case PGR 2020-00072 for U.S. Pat. No. 10,429,161 B2, Petition for Post Grant Review of Claims 1-20 of U.S. Pat. No. 10,429,161 Under 35 U.S.C. §§ 321-28 and 37 C.F. R. §§42.200 ET Seq., dated Jun. 30, 2020, 109 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-final Office Action of U.S. Appl. No. 16/451,440, dated Oct. 24, 2019, 22 pgs.
United States Patent and Trademark Office, Non-final Office Action of U.S. Appl. No. 16/455,816, dated Jul. 2, 2020, 15 pgs.
United States Patent and Trademark Office, Non-final Office Action of U.S. Appl. No. 16/455,816, dated Nov. 5, 2019, 17 pgs.
United States Patent and Trademark Office, Notice of Allowance for U.S. Appl. No. 15/920,800, dated Jul. 7, 2020, 7 pgs.
United States Patent and Trademark Office, Notice of Allowance for U.S. Appl. No. 16/585,790, dated Jun. 19, 2020, 16 pgs.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan. 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/272,326, dated May 24, 2019 17 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/423,789, dated Feb. 18, 2020, 14 pgs.
United States Patent and Trademark Office, Office Action of U.S. Appl. No. 16/455,816, dated Apr. 20, 2020, 21 pgs.
United States Patent and Trademark Office, Office Action of U.S. Appl. No. 16/455,816, dated Jan. 13, 2020, 14 pgs.
United States Patent and Trademark Office, Office Action of U.S. Appl. No. 16/503,839, dated Jul. 14, 2020, 13 pgs.
United States Patent and Trademark Office, Office Action of U.S. Appl. No. 16/511,495, dated Aug. 27, 2020, 20 pgs.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office; Final Office Action of U.S. Appl. No. 16/540,484; dated Mar. 30, 2020; 12 pgs.
United States Patent and Trademark Office; Non-Final Office Action for U.S. Appl. No. 15/068,786; dated Mar. 27, 2017; 9 pages.
United States Patent and Trademark Office; Non-Final Office Action for U.S. Appl. No. 15/612,953; dsted Feb. 14, 2018; 10 pages.
United States Patent and Trademark Office; Non-Final Office Action for U.S. Appl. No. 16/056,944; dated Mar. 18, 2019; 12 pages.
United States Patent and Trademark Office; Non-Final Office Action for U.S. Appl. No. 16/156,339; dated Dec. 13, 2018; 8 pages.
United States Patent and Trademark Office; Non-Final Office Action for U.S. Appl. No. 16/542,890; dated Nov. 4, 2019; 16 pages.
United States Patent and Trademark Office; Notice of Allowance for U.S. Appl. No. 29/733,080; dated Oct. 20, 2020; 9 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/423,789 dated Jul. 23, 2020 7 pages.
United States Patent and Trademark Office; Notice of Allowance for U.S. Appl. No. 16/503,839 dated Oct. 8, 2020; 15 pages.
United States Patent and Trademark Office; Office Action of U.S. Appl. No. 16/540,484, dated Aug. 20, 2020, 10 pgs.
United States Patent and Trademark Office; Non-Final Office Action for U.S. Appl. No. 15/920,812 dated Feb. 3, 2021; 5 pages.
Amit Govil, Selective Perforation: A Game Changer in Perforating Technology - Case Study, presented at the 2012 European and West African Perforating Symposium, Schlumberger, Nov. 7-9. 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011;11 pages.
Brazilian Patent and Trademark Office; Search Report for BR Application No. BR112015033010-0; dated May 5, 2020; (4 pages).
Burndy, Bulkhead Ground Connector, Mechanical Summary Sheet, The Grounding Superstore, Jul. 15, 2014,1 page, https://www.burndy.com/docs/default-source/cutsheets/bulkhead-connect.

(56) References Cited

OTHER PUBLICATIONS

Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019 4 pages.
Cao et al., Study on energy output efficiency of mild detonating fuse in cylindertube structure, Dec. 17, 2015, 11 pgs., https://www.sciencedirect.com/science/article/pii/S0264127515309345.
Core Lab, ZER0180™ Gun SystemAssembly and Arming Procedures, 2015, 33 pgs., https://www.corelab.com/awen/CMS/docs/Manuals/gunsys/zerol 80/MAN-Z180-000 pdf.
Djresource, Replacing Signal and Ground Wire, May 1, 2007, 2 pages, http://www.djresource.eu/Topics/story/110/Technics-SL-Replacing-Signal-and-Ground-Wire/.
Dynaenergetics GmbH & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600 Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Dynaenergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.
Dynaenerge 1 ics; DynaStage Solution—Factory Assembled Performance-Assured Perforating Systems; 6 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European U.S. Appl. No. 15/721,178 0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851) dated May 17, 2018; 15 pages (English translation 4 pages).
Federal Institute of Industrial Property; Decision on Granting a Patent for Invention Russian App. No 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Decision on Granting for RU Application No. 2016109329/03 dated Oct. 21, 2019; 11 pages (English translation 4 pages).
Federal Institute of Industrial Property; Decision on Granting for RU Application No. 2019137475/03 dated May 12, 2020; 15 pages (English translation 4 pages).
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU App. No. 2016109329/03(014605); issued Jul. 10, 2019; 7 pages (Eng. Translation 5 pages).
Federal Institute of Industrial Property; Inquiry for RU Application No. 2016110014/03(015803); issued Feb. 1, 2018; 6 pages (Eng. Translation 4 pages).
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB AppL No. 1717516.7; dated Apr. 13, 2018; 3 pages.
GB Intellectual Property Office; Notification of Grant for GB Appl. No. 1717516.7; dated Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
GeoDynamics; "Vapr"; promotional brochure; Oct. 1, 2019.
German Patent Office, Office Action for German Patent Application No. 10 2013 109 227.6, which is in the same family as PCT Application No. PCT/EP2014/065752, see p. 5 for references cited, dated May 22, 2014, 8 pgs.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service,ControlFire RF Safe ControlFire@ RF-Safe Manual, 33 pgs., Jul. 2016, http://www.hunting-intl.com/media/2667160/ControlFire%20RF_Assembly%20Gun%20Loading_Manualpdf.
Hunting Energy Services Pte Ltd., "H-1 Perforating Gun System"; promotional brochure; Jun. 21, 2019.
Hunting Titan Division, Marketing White Paper: H-1® Perforating Gun System, Jan. 2017, 5 pgs., http://www.hunting-intl.com/media/2674690/White%20Paper%20-%20H-1%20Perforating%20Gun%20Systems_January%202017.pdf.
Hunting Titan Inc., Petition for Inter Parties Review of U.S. Pat. No. 9,581,422, filed Feb. 16, 2018, 93 pgs.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan, H-1® Perforating Gun System, 2016, 2 pgs., http://www.hunting-intl.com/titan.
Core Lab ZERO180 Gun System Assembly and Arming Procedures; Copyright 2015-2021 Owen Oil Tools; dated May 7, 2021; 38 pages.

* cited by examiner

CONDUCTIVE DETONATING CORD FOR PERFORATING GUN

CROSS-REFERENCE TO RELATED APPLICATIONS

This application is a continuation patent application of U.S. application Ser. No. 16/503,839 filed Jul. 5, 2019, which is a divisional patent application of U.S. application Ser. No. 16/152,933 filed Oct. 5, 2018, now U.S. Pat. No. 10,386,168, which claims the benefit of U.S. Provisional Application No. 62/683,083 filed Jun. 11, 2018, each of which is incorporated herein by reference in its entirety.

BACKGROUND OF THE DISCLOSURE

Perforating gun assemblies are used in many oilfield or gas well completions. In particular, the assemblies are used to generate holes in steel casing pipe/tubing and/or cement lining in a wellbore to gain access to the oil and/or gas deposit formation. In order to maximize extraction of the oil/gas deposits, various perforating gun systems are employed. These assemblies are usually elongated and frequently cylindrical, and include a detonating cord arranged within the interior of the assembly and connected to shaped charge perforators (or shaped charges) disposed therein.

The type of perforating gun assembly employed may depend on various factors, such as the conditions in the formation or restrictions in the wellbore. For instance, a hollow-carrier perforating gun system having a tube for carrying the shaped charges may be selected to help protect the shaped charges from wellbore fluids and pressure (the wellbore environment). An alternative perforating gun system often used is an exposed or encapsulated perforating gun system. This system may allow for the delivery of larger sized shaped charges than those of the same outer diameter sized hollow-carrier gun system. The exposed perforating gun system typically includes a carrier strip upon which shaped charges are mounted. Because these shaped charges are not contained within a hollow tube, as those of a hollow-carrier perforating gun system, the shaped charges are individually capsuled.

Typically, shaped charges are configured to focus ballistic energy onto a target to initiate production flow. Shaped charge design selection is also used to predict/simulate the flow of the oil and/or gas from the formation. The configuration of shaped charges may include conical or round aspects having an initiation point formed in a metal case, which contains an explosive material, with or without a liner therein, and that produces a perforating jet upon initiation. It should be recognized that the case or housing of the shaped charge is distinguished from the casing of the wellbore, which is placed in the wellbore after the drilling process and may be cemented in place in order to stabilize the borehole and isolate formation intervals prior to perforating the surrounding formations.

Current perforating gun systems are mechanically connected via tandem sub assemblies. For wireline conveyance and selective perforating, the perforating gun is also electrically connected to an adjacent perforating gun by a bulkhead, which is included in the tandem sub. The bulkhead typically provides pressure isolation and includes an electric feedthrough pin. Each perforating gun may include multiple wires, such as feed-through or grounding wires as well as a detonating cord, which typically run parallel to each other through the length of the perforating gun. The feed-through wire is typically configured to electrically connect a perforating gun to an adjacent perforating gun, and the detonating cord is typically configured to initiate shaped charges disposed in each perforating gun. Further description of such perforating guns may be found in commonly-assigned U.S. Pat. Nos. 9,605,937, 9,581,422, 9,494,021, and 9,702,680, each of which are incorporated herein by reference in their entireties. Other perforating gun systems may utilize charge tubes/charge cartridges as a reduction option for the feed-through wire or separate electronic switches in the gun (sometimes externally connected to the detonator) that allows you to switch between different gun assemblies. Such perforating guns are described in U.S. Pat. Nos. 8,689,868, 8,884,778, 9,080,433, and 9,689,223. The use of multiple wires often requires additional assembly steps and time, which may result in increased assembly costs.

In view of the disadvantages associated with currently available perforating gun assemblies there is a need for a device that reduces assembly steps and time and improves safety and reliability of perforating gun assemblies. There is a further need for a perforating gun having simplified wiring, which may reduce human error in assembling perforating gun systems. Further, this results in a need for a detonating cord that relays/transfers electrical signals along a length of a perforating gun, without requiring additional wires, and without the need to isolate conductive elements.

BRIEF DESCRIPTION OF THE EXEMPLARY EMBODIMENTS

According to an aspect, the present embodiments may be associated with a detonating cord for using in a perforating gun. The detonating cord includes an explosive layer and an electrically non-conductive layer. An insulating layer extends along a length of the detonating cord, between the explosive layer and the electrically conductive layer. The electrically conductive layer may include a plurality of conductive threads and is configured to relay/transfer a communication signal along the length of the detonating cord. In an embodiment, a jacket/outer jacket layer extends around the electrically conductive layer of the detonating cord. The conductive detonating cord may further include a plurality of non-conductive threads spun/wrapped around the explosive layer. The jacket may help protect any of the inner layers (such as the explosive, electrically conductive and insulating layers) from damage due to friction by external forces.

Additional embodiments of the disclosure may be associated with a perforating gun. The perforating gun includes a detonating cord configured substantially as described hereinabove, and is energetically and electrically coupled to a detonator. The detonating cord includes an explosive layer, an electrically conductive layer and an insulating layer in between the explosive layer and the electrically conductive layer. The detonator further includes a plurality of non-conductive threads around the explosive layer, and a jacket that covers the electrically conductive layer. The non-conductive threads adds strength and flexibility to the detonating cord, while the jacket helps to protect the layers of the detonating cord from damage due to friction by external forces. According to an aspect, the detonating cord spans the length of the perforating gun and connects to at least one shaped charge positioned in the perforating gun. The detonating cord is configured to relay/transfer a communication signal along a length of the detonating cord, and to propagate a detonating explosive stimulus along its length and to the shaped charge.

Further embodiments of the disclosure are associated with a method of electrically connecting a plurality of perforating guns that each include the aforementioned detonating cord. The perforating guns may be connected in series, with the detonating cord of a first perforating gun in electrical communication with the detonating cord of a second perforating gun. This arrangement reduces the number of wires within each perforating gun, while facilitating the connection to adjacent perforating guns via a bulkhead connection or a booster kit with electric contact function.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
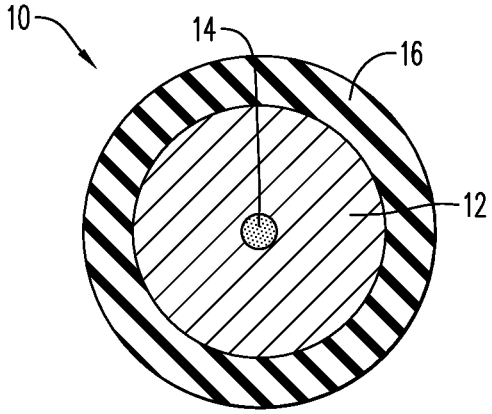
FIG. 1A is a cross-sectional view of a detonating cord/electrically conductive detonating cord, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Figure 1B:
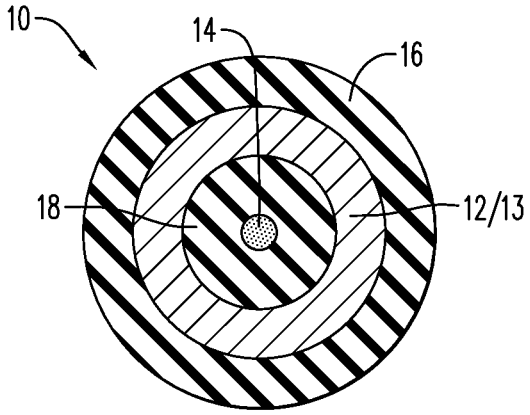
FIG. 1B is a cross-sectional view of a detonating cord/electrically conductive detonating cord including an insulating layer, according to an embodiment.

For purposes of illustrating features of the embodiments, reference be made to various figures. FIGS. 1A-1B illustrate various features of a detonating cord for use in a perforating gun/perforating gun assemblies. As will be discussed in connection with the individual illustrated embodiments, the detonator generally is connected electrically, which requires the transmission of a communication signal (i.e., electric current) through a lead wire or along the length of the conductive detonating cord. The electric current may be used to transmit telemetry signals, charge down-hole capacitors, initiate detonators in perforating gun assemblies, and communicate to other devices such as an igniter for bridge plug setting tool which are positioned below the perforating gun assembly. The electrically conductive materials of the detonating cord helps to reduce the number of required wires in perforating gun assemblies, and helps to facilitate the electrical connection between a plurality of perforating guns.

Embodiments of the disclosure may be associated with a detonating cord/electrically conductive detonating cord 10. The detonating cord 10 may be a flexible structure that allows the detonating cord 10 to be bent or wrapped around structures. According to an aspect, the detonating cord 10 may include a protective structure or sheath 16 that prevents the flow of an extraneous or stray electric current through the explosive layer 14 within the detonating cord 10.

According to an aspect, and as illustrated in FIGS. 1A-2B, the detonating cord 10 includes an explosive layer/linear explosive layer 14. The explosive layer 14 may include an insensitive secondary explosive (i.e., an explosive that is less sensitive to electrostatic discharge (ESD), friction and impact energy within the detonating cord, as compared to a primary explosive). According to an aspect, the explosive layer 14 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), Hexanitrostilbene (HNS), 2,6-Bis (picrylamino)-3,5-dinitropyridine (PYX), and nonanitroterphenyl (NONA). The type of material selected to form the explosive layer 14 may be based at least in part on the temperature exposure, radial output and detonation velocity of the material/explosive. In an embodiment, the explosive layer includes a mixture of explosive materials, such as, HNS and NONA. As would be understood by one of ordinary skill in the art, the explosive layer 14 may include compressed explosive materials or compressed explosive powder. The explosive layer 14 may include constituents to improve the flowability of the explosive powder during the manufacturing process. Such constituents may include various dry lubricants, such as, plasticizers, graphite, and wax.

The detonating cord 10 further includes an electrically conductive layer 12. The electrically conductive layer 12 is configured to relay/transfer a communication signal along the length L of the detonating cord 10. The communication signal may be a telemetry signal. According to an aspect, the communication signal includes at least one of a signal to, check and count for detonators in a perforating gun string assembly, address and switch to certain detonators, charge capacitors and to send a signal to initiate a detonator communicably connected to the detonating cord 10. The integration of the electrically conductive layer 12 in the detonating cord 10 helps to omit the electric feed-through wires presently being used.

According to an aspect, the electrically conductive layer 12 extends around the explosive layer 14 in a spaced apart configuration. As will be described in further detail hereinbelow, an insulating layer 18 may be sandwiched between the explosive layer 12 and the electrically conductive layer 12. The electrically conductive layer 14 of the detonating cord 10 may include a plurality of electrically conductive threads/fibers spun or wrapped around the insulating layer 18, or an electrically conductive sheath/pre-formed electrically conductive sheath 13 in a covering relationship with the insulating layer 18. According to an aspect, the electrically conductive sheath 13 comprises layers of electrically conductive woven threads/fibers that are pre-formed into a desired shape that allows the electrically conductive sheath to be easily and efficiently placed or arranged over the insulating layer 18. The layers of electrically conductive woven threads may be configured in a type of crisscross or overlapping pattern in order to minimize the effective distance the electrical signal must travel when it traverses through the detonating cord 10. This arrangement of the threads helps to reduce the electrical resistance (Ohm/ft or Ohm/m) of the detonating cord 10. The electrically conductive threads and the electrically conductive woven threads may include metal fibers or may be coated with a metal, each metal fiber or metal coating having a defined resistance value (Ohm/ft or Ohm/m). It is contemplated that longer gun strings (i.e., more perforating guns in a single string) may be formed using perforating guns that including the electrically conductive detonating cord 10.

Figure 2A:
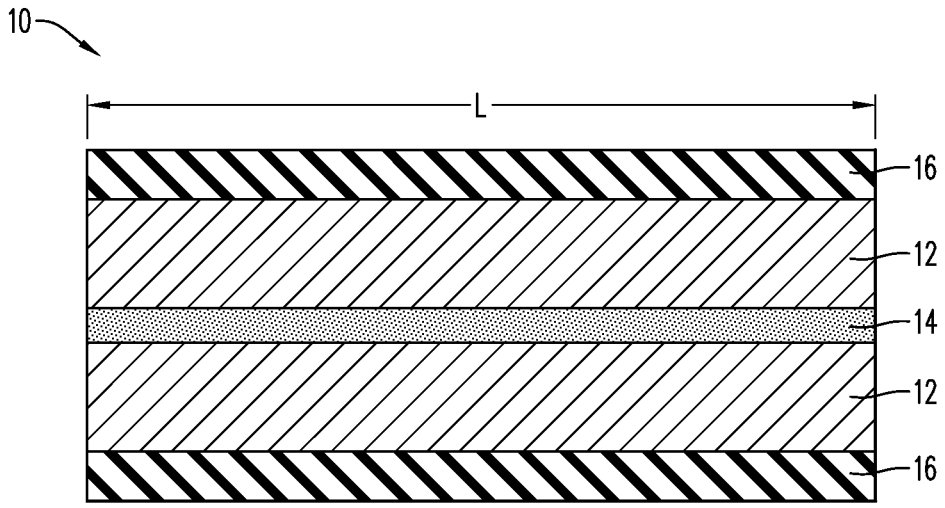
FIG. 2A is a side, cross-sectional view of the detonating cord of FIG. 1A.
Figure 2B:
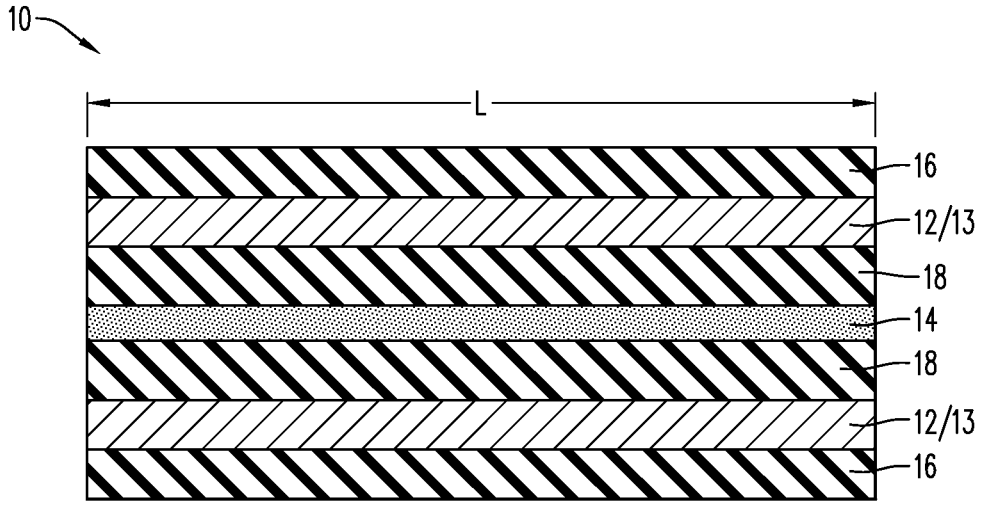
FIG. 2B is a side, cross-sectional view of the detonating cord of FIG. 1B.

FIG. 1B and FIG. 2B illustrate the detonating cord 10 including an insulating layer 18. The insulating layer 18 is disposed/positioned between the explosive layer 14 and the electrically conductive layer 12. As illustrated in FIG. 2B, for example, the insulating layer 18 may extend along the length L of the detonating cord 10. According to an embodiment (not shown), the insulating layer 18 may only extend along a portion of the length L of the detonating cord, where the explosive layer 14 would potentially be adjacent the electrically conductive layer 12. The insulating layer may be formed of any nonconductive material. According to an aspect, the insulating layer 18 may include at least one of a plurality of non-conductive aramid threads, a polymer, such as fluorethylenpropylene (FEP), polyamide (PA), polyethylenterephthalate (PET), or polyvinylidenfluoride (PVDF), and a coloring additive.

The detonating cord 10 may include a layer of material along its external surface to impart additional strength and protection to the structure of the detonating cord 10. FIGS. 1A-2B each illustrate a jacket/outer protective jacket 16 externally positioned on the detonating cord 10. According to an aspect, the jacket 16 is formed of at least one layer of woven threads. The jacket 16 may be formed from a nonconductive polymer material, such as FEP, PA, PET, and PVDF. According to an aspect, the jacket 16 is formed of at least one layer of non-conductive woven threads and covered by a sheath formed from a plastic, composite or lead.

As illustrated in FIGS. 1A and 1B, the jacket 16 extends around/surrounds/encases the electrically conductive layer 12 or the electrically conductive sheath 13, the insulating layer 18, and the explosive layer 14. The jacket 16 extends along the length L of the detonating cord 10, and may be impervious to at least one of sour gas ($H_2S$), water, drilling fluid, and electrical current.

Figure 3A:
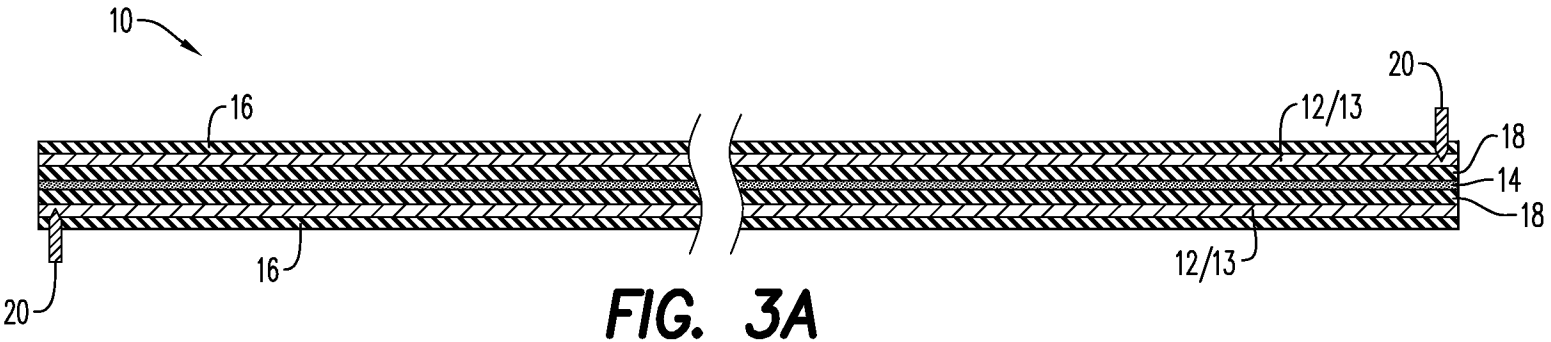
FIG. 3A is a side, partial cross-sectional view of a detonating cord/electrically conductive detonating cord, illustrating contacts embedded therein, according to an embodiment.
Figure 3B:
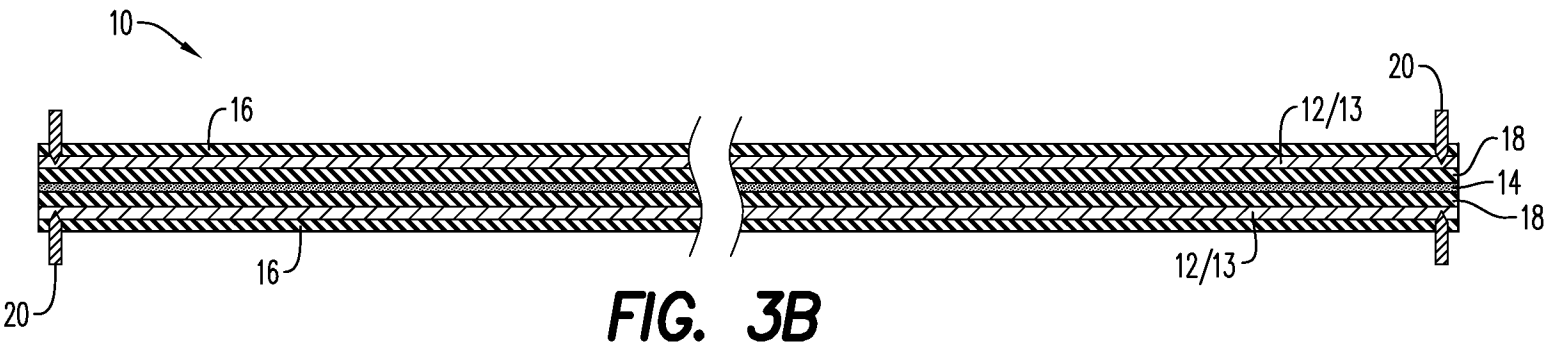
FIG. 3B is a side, partial cross-sectional view of a detonating cord/electrically conductive detonating cord illustrating contacts extending around a portion of the detonating cord, according to an embodiment.

According to an aspect, electric pulses, varying or alternating current or constant/direct current may be induced into or retrieved from the electrically conductive layer 12/electrically conductive sheath 13 of the detonating cord 10. FIG. 3A and FIG. 3B illustrate the detonating cord 10 including contacts 20. According to an aspect, the contacts 20 may include a metal, such as aluminum, brass, copper, stainless steel or galvanized steel (including zinc).

The contacts 20 are configured to input a communication signal at a first end/contact portion of the detonating cord 10 and output the communication signal at a second end/contact portion of the detonating cord 10. In order to facilitate the communication of the communication signal, the contacts 20 may at least partially be embedded into the detonating cord 10. The contacts 20 may be coupled to or otherwise secured to the detonating cord 10. According to an aspect, the contacts 20 are crimped onto the detonating cord 10, in such a way that the contacts 20 pierce through the protective outer jacket 16 of the detonating cord 10 to engage the electrically conductive layer 12 or the conductive sheath 13.

Figure 4A:
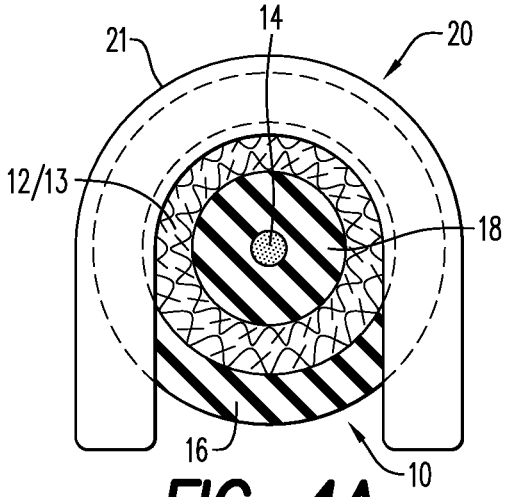
FIG. 4A is a cross-sectional view of a split sleeve contact partially extending around and partially embedded in a detonating cord/electrically conductive detonating cord, according to an embodiment.

FIG. 4A illustrates the contacts 20 extending around and cutting into a portion of the jacket 16. The contact may include a split sleeve 21, that engages and contacts with at least a portion of the electrically conductive layer 12. The split sleeve 21 includes a longitudinal split, which allows the split sleeve 21 to be temporarily bent or deformed to be placed on or be positioned over the detonating cord 10. The split sleeve 21 may include a plurality of retention features (not shown) that pierce through the jacket 16 and engages with the electrically conductive threads 12.

Figure 4B:
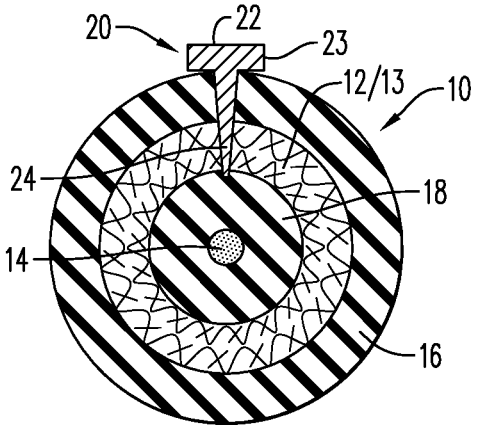
FIG. 4B is a cross-sectional view of a contact including a conductive pin partially embedded in a detonating cord/electrically conductive detonating cord, according to an embodiment.
Figure 4C:
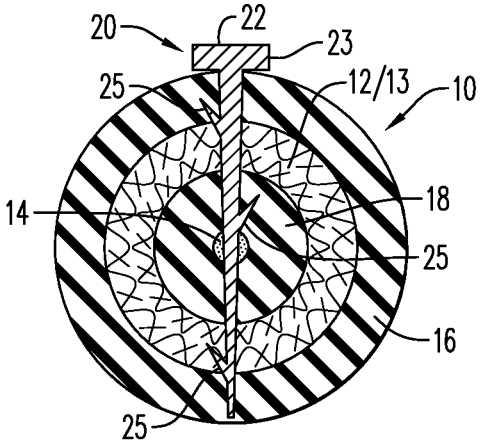
FIG. 4C is a cross-sectional view of a contact including a conductive pin having retention mechanisms and partially embedded in a detonating cord/electrically conductive detonating cord, according to an embodiment.
Figure 5:
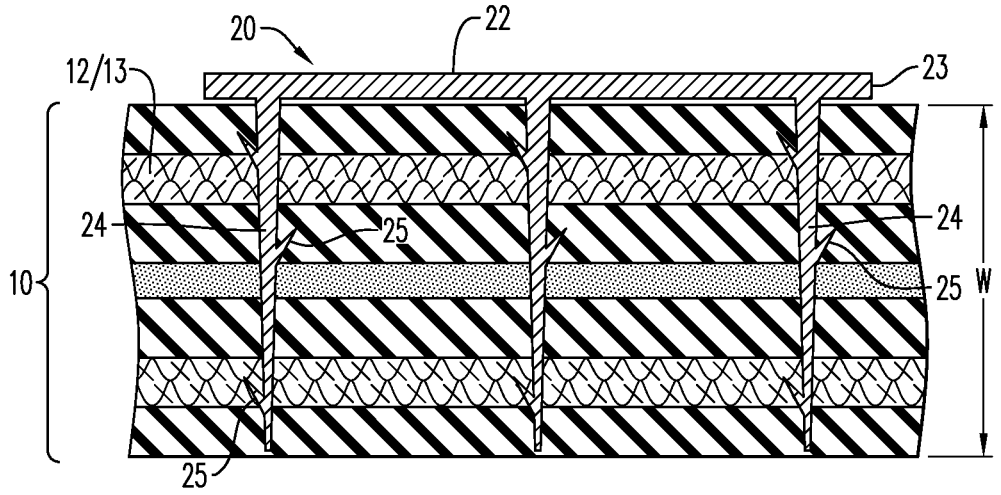
FIG. 5 is a side, cross-sectional view of the contact of FIG. 4C, illustrating a plurality of lower portions and retention mechanisms.

FIGS. 4B and 4C illustrate the contacts 20 including a conductive pin 22. The conductive pin 22 includes an upper portion 23, and at least one lower portion 24 extending from the upper portion 23. The lower portion 24 is configured for engaging the electrically conductive layer 12 of the detonating cord, while the upper portion 23 facilitates the proper placement/arrangement of the conductive pin 22 and, if necessary, facilitates the removal of the conductive pin 22 from the detonating cord 10. As illustrated, for instance, in FIG. 5, the lower portion 24 may be sized to extend across (partially or fully) a width W of the detonating cord 10. According to an aspect and as illustrated in FIG. 4C and FIG. 5, the lower portion 24 may include a plurality of retention mechanisms 25. The retention mechanisms 25 may be shaped as spikes or as barbs that engage with at least one of the layers of the detonating cord 10. FIG. 5 illustrates the retention mechanisms 25 pierced through the entire width W of the detonating cord 10.

While the arrangements of the layers of the detonating cord 10 have been illustrated in FIGS. 1A-5 and described in detail hereinabove, it is to be understood that the layers may be arranged in different orders based on the application in which the detonating cord 10 will be used. For example, the electrically conductive layer 12 may be the innermost layer, with the insulating layer 18 adjacent the conductive layer, and the explosive layer 14 extending around the insulating layer 18 (not shown). The jacket 16 extends around the layers and helps protect the detonating cord 10 from damage and exposure to undesired friction and liquids.

Figure 6:
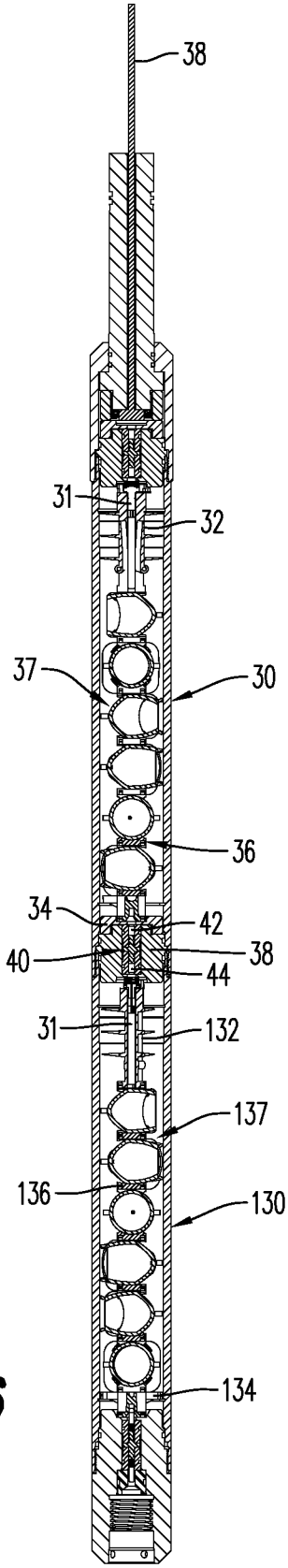
FIG. 6 is a side, cross-sectional view of a perforating gun including a detonating cord/electrically conductive detonating cord, according to an embodiment.

Further embodiments of the disclosure are associated with a perforating gun 30/adjacent perforating guns 130, as illustrated in FIGS. 6A-8. FIGS. 6, 6A and 6B and FIG. 7 illustrate the perforating gun 30/130 including a top connector 32, a bottom connector 34, and a charge holder 36. As illustrated in FIG. 6, multiple charge holders 36 may extend between the top and bottom connectors 32, 34. Each charge holder 36 is configured for holding a shaped charge 37. The shaped charges 37 may be of any size or of any general shape, such as conical or rectangular. While the shaped charges 37 illustrated are open/un-encapsulated shaped charges, it is contemplated that the charge holders 36 may include encapsulated shaped charges.

Figure 6A:
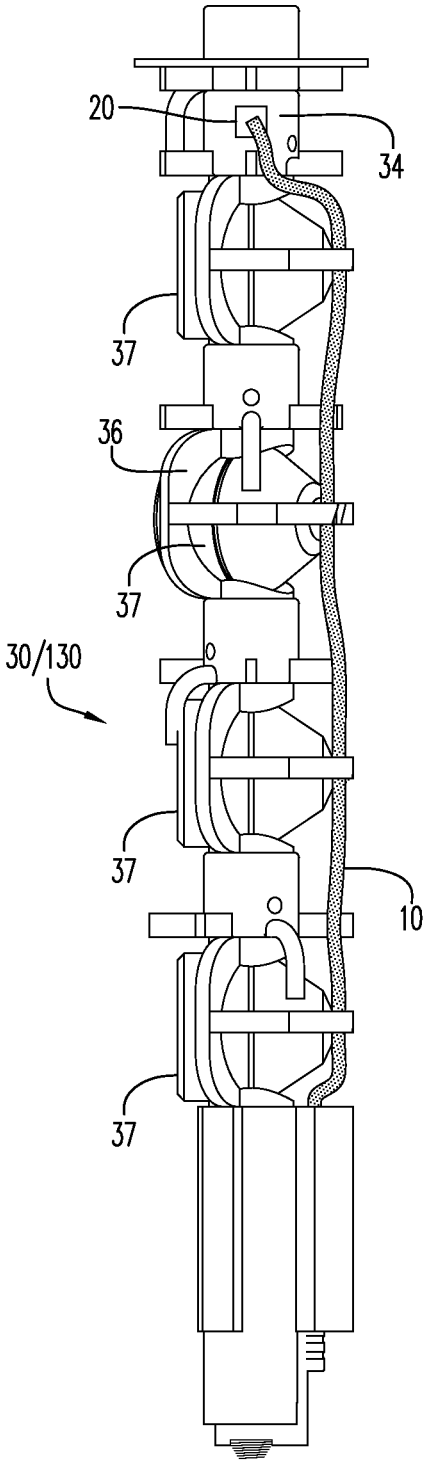
FIG. 6A is a side, perspective view of the perforating gun of FIG. 6, illustrating the arrangement of the electrically conductive detonating cord.
Figure 8:
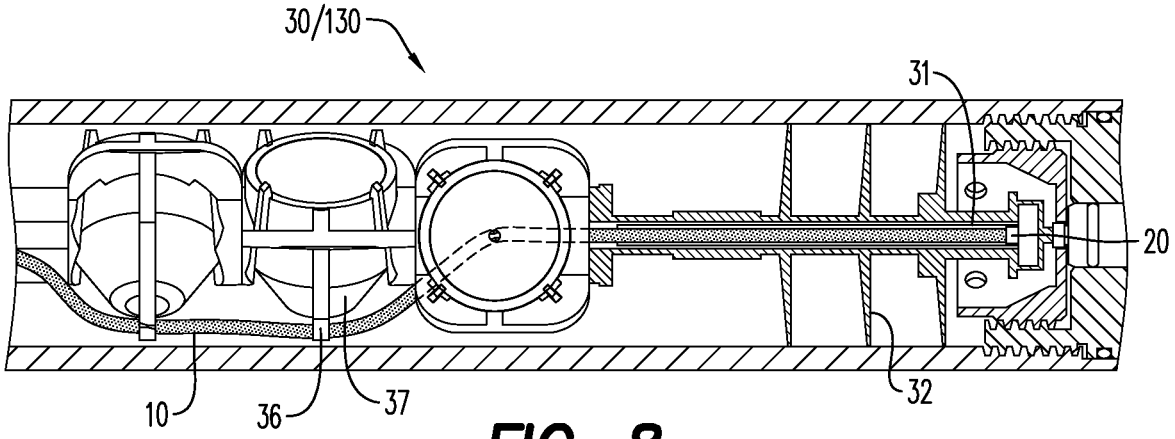
FIG. 8 is a side, partial cross-sectional view of the perforating gun of FIG. 6, illustrating a detonator housed in a top connector, and a detonating cord extending from the top connector to a charge holder.

As illustrated in FIGS. 6A and 8, the perforating gun 30/130 includes a detonating cord 10. The detonating cord 10 may extend from the top connector 32 to the bottom connector 34, and may be connected to each of the shaped charges 37 positioned in the perforating gun 30. The detonating cord 10 is configured to initiate the shaped charge 37 disposed in each charge holder 36. For purposes of convenience, and not limitation, the general characteristics of the detonating cord 10 described hereinabove with respect to FIGS. 1A-5, are not repeated here.

The detonating cord 10 electrically connects the top connector 32 to the bottom connector 34, which in return connects to an adjacent perforating gun 130 (FIGS. 6, 6A-6B and FIG. 7). In this configuration, the detonating cord 10 electrically connects contact points/areas in the top connector 32 of the perforating gun 30 to a corresponding contact point/area in the bottom connector 134 of an adjacent perforating gun 130. According to an aspect, the top connector 132 of the adjacent perforating gun 130 may be electrically connected to a corresponding bottom connector of another adjacent perforating gun.

Figure 6B:
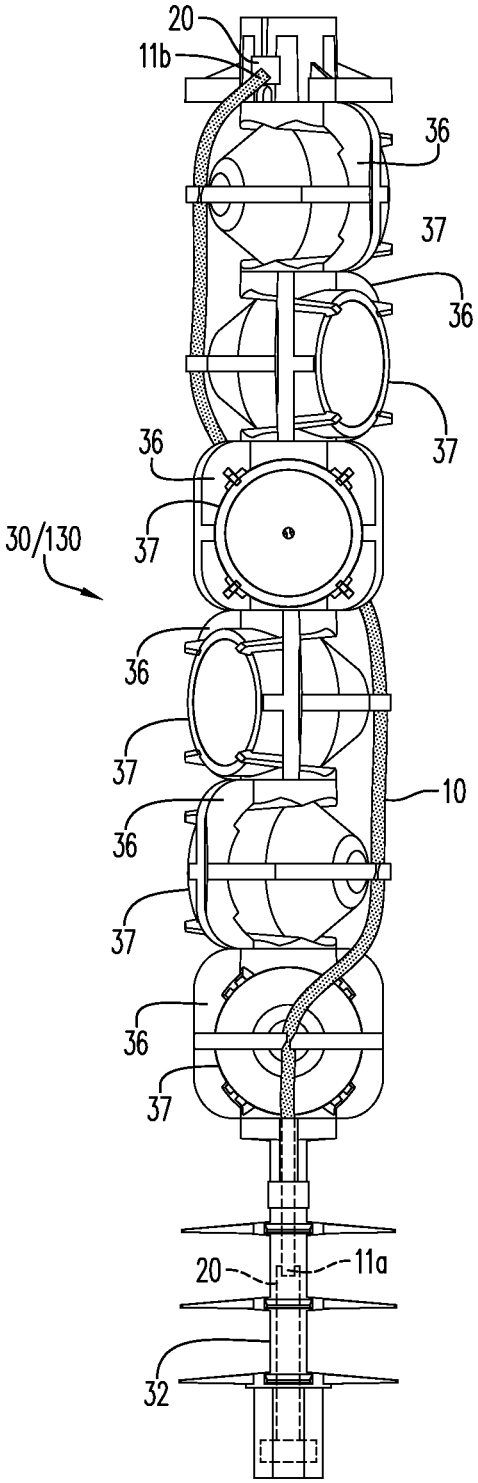
FIG. 6B is a side, perspective view of the perforating gun of FIG. 6, illustrating the arrangement of the components of the perforating gun.
Figure 7:
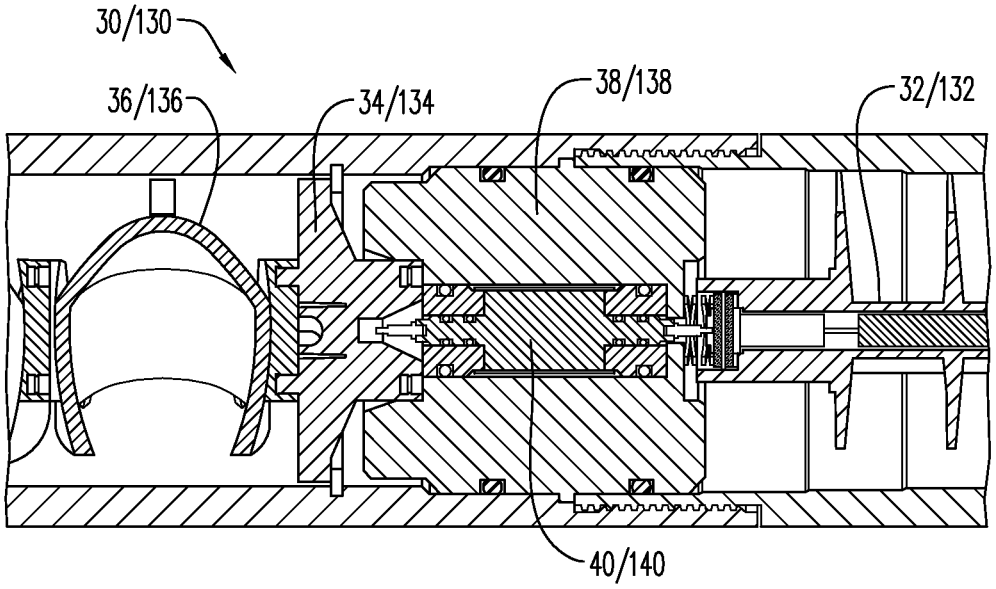
FIG. 7 is a side, cross-sectional view of a portion of the perforating gun of FIG. 6.

The perforating gun 30/adjacent perforating gun 130 may include one or more contacts 20, configured substantially as described hereinabove and illustrated in FIGS. 3A-5. Thus, for purposes of convenience and not limitation, the features and structure of the contacts 20 described above and illustrated in FIGS. 3A-5 are not repeated here. According to an aspect, the contacts may include a first contact and a second contact. The first contact may be positioned or otherwise disposed in the top connector 32, while the second contact may be positioned or otherwise disposed in the bottom connector 34 (FIGS. 6A-6B and 8).

The perforating gun 30 may further include a tandem seal adapter 38 configured for housing a bulkhead assembly 40. The bulkhead assembly 40 may include a first end/first electrical contact end 42 and a second end/second electrical contact end 44. According to an aspect, the first end 42 is electrically connected to the bottom connector 34 of the perforating gun 30, and the second end 44 is electrically connected to a top connector 132 of an adjacent (or downstream) perforating gun 130. According to an aspect, a communication signal is communicated through the bulkhead assembly of the tandem seal adapter 38 to the adjacent perforating gun 130, via at least the detonating cord 10 including the electrically conductive layer 12.

FIG. 8 illustrates a detonator 31 arranged in the top connector 32. The detonator 31 is energetically and electrically coupled to the detonating cord 10 through the contacts 20. As described in detail hereinabove, the contacts 20 input the communication signal at a first end/contact portion 11*a* of the detonating cord 10 and output the communication signal at a second end/contact portion 11*b* of the detonating cord 10. The communication signal is at least one of a telemetry signal, a signal to check and count for detonators in the gun string assembly, address and switch to certain detonators, to charge capacitors, and a signal to initiate the detonator 31.

According to an aspect, the detonator 31 is one of an RF-safe electronic detonator, a resistorized/electric detonator, or a detonator using a fire set, an EFI, an EBW, a semiconductor bridge and/or an igniter. The detonator 31 may include a line-in portion, and a line-out portion and a grounding contact. The line-in portion of the detonator 31 may be connected to the second end 44 of the bulkhead assembly 40, which may be electrically connected to the top connector 132 of the adjacent perforating gun 130. The line-out portion of the detonator 31 may connect to the first end 42 of an adjacent bulkhead assembly 140 that is electrically connected to a bottom connector 134 of the adjacent perforating gun 130. According to an aspect, the adjacent perforating gun 130 may be a bottommost perforating gun, and the communication signal may be an electric signal that is relayed/transferred to the bottommost perforating gun from the top perforating gun 30.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A detonating cord comprising:

an explosive layer;

an electrically conductive layer extending around the explosive layer;

a jacket extending around the electrically conductive layer;

a contact secured to the jacket and extending into at least a portion of the electrically conductive layer, the contact being configured to pierce the jacket to engage the electrically conductive layer, wherein the explosive layer, the electrically conductive layer and the jacket each extends along a length of the detonating cord, and the electrically conductive layer is configured to transfer a communication signal along the length of the detonating cord.

2. The detonating cord of claim 1, wherein the contact comprises:

a conductive pin.

3. The detonating cord of claim 2, wherein the conductive pin comprises:

an upper portion; and at least one lower portion extending from the upper portion, wherein the lower portion is configured for engaging the electrically conductive layer.

4. The detonating cord of claim 3, wherein the lower portion comprises a plurality of retention mechanisms configured for securing the conductive pin within the electrically conductive layer.

5. The detonating cord of claim 1, further comprising:

an insulating layer extending along the length of the detonating cord between the explosive layer and the electrically conductive layer.

6. The detonating cord of claim 1, further comprising:

a first contact portion configured for receiving the communication signal; and a second contact portion spaced apart from the first contact portion and configured for outputting the communication signal.

7. The detonating cord of claim 6, wherein the contact further comprises:

a first contact secured to the first contact portion; and a second contact secured to the second contact portion.

8. The detonating cord of claim 6, wherein the first contact is one of a first split sleeve and a first conductive pin; and the second contact is one of a second split sleeve and a second conductive pin.

9. A detonating cord comprising:

an explosive layer;

an electrically conductive layer extending around the explosive layer, the electrically conductive layer comprising an electrically conductive thread;

a jacket extending around the electrically conductive layer;

a contact secured to the jacket and extending into at least a portion of the electrically conductive layer such that the contact is in electrical communication with the electrically conductive thread, wherein the explosive layer, the electrically conductive layer and the jacket each extends along a length of the detonating cord, and the electrically conductive layer is configured to transfer a communication signal along the length of the detonating cord.

10. The detonating cord of claim 9, further comprising:

an insulating layer extending along the length of the detonating cord between the explosive layer and the electrically conductive layer.

11. The detonating cord of claim 10, wherein the electrically conductive thread comprises:

a plurality of electrically conductive fibers spun or wrapped around the insulating layer.

12. The detonating cord of claim 9, further comprising:

a first contact portion configured for receiving the communication signal; and a second contact portion spaced apart from the first contact portion, and configured for outputting the communication signal.

13. The detonating cord of claim 12, wherein the contact further comprises:

a first contact secured to the first contact portion; and a second contact secured to the second contact portion.

14. The detonating cord of claim 13, wherein the first contact is one of a first split sleeve and a first conductive pin; and the second contact is one of a second split sleeve and a second conductive pin.

15. A detonating cord comprising:

an explosive layer;

an electrically conductive layer extending around the explosive layer, the electrically conductive layer comprising an electrically conductive sheath;

a jacket extending around the electrically conductive layer;

a contact secured to the jacket and extending into at least a portion of the electrically conductive layer such that the contact is in electrical communication with the electrically conductive sheath, wherein the explosive layer, the electrically conductive layer and the jacket each extends along a length of the detonating cord, and the electrically conductive layer is configured to transfer a communication signal along the length of the detonating cord.

16. The detonating cord of claim 15, wherein the electrically conductive sheath comprises a layer of electrically conductive woven threads spun or wrapped around an insulating layer that extends along at least a portion of the explosive layer.

17. The detonating cord of claim 16, wherein the layer of electrically conductive woven threads comprises at least one of a plurality of metal fibers and a plurality of metal coated fibers.

18. The detonating cord of claim 15, further comprising:

a first contact portion configured for receiving the communication signal; and a second contact portion spaced apart from the first contact portion, and configured for outputting the communication signal.

19. The detonating cord of claim 18, wherein the contact further comprises:

a first contact secured to the first contact portion; and a second contact secured to the second contact portion.

20. The detonating cord of claim 19, wherein the first contact is one of a first split sleeve and a first conductive pin; and the second contact is one of a second split sleeve and a second conductive pin.

* * * * *